US005234064A

United States Patent [19]

Lenaburg

[11] Patent Number: 5,234,064

[45] Date of Patent: Aug. 10, 1993

[54] ROLLER CUTTER ASSEMBLY HAVING ADJUSTABLE RING CUTTER SPACING

[75] Inventor: Carl E. Lenaburg, Seattle, Wash.

[73] Assignee: The Robbins Company, Kent, Wash.

[21] Appl. No.: 848,259

[22] Filed: Mar. 9, 1992

[51] Int. Cl.[5] ..... E21B 9/24

[52] U.S. Cl. ..... 175/373; 175/384; 299/80

[58] Field of Search ..... 175/361, 371, 372, 373, 175/374, 381, 382, 384; 299/80

[56] References Cited

U.S. PATENT DOCUMENTS

| | | | |
|---|---|---|---|
| 2,223,864 | 12/1940 | Zublin . | |
| 3,596,724 | 8/1971 | Beechem | 175/331 |
| 3,766,998 | 10/1973 | Bower, Jr. | 175/373 |
| 3,786,879 | 1/1974 | Murdoch | 175/374 |
| 3,791,465 | 2/1974 | Metge | 175/373 |
| 3,981,370 | 9/1976 | Bingham et al. | 175/373 |
| 4,010,808 | 3/1977 | Youngblood | 175/384 X |
| 4,298,080 | 11/1981 | Hignett | 175/373 |
| 4,339,009 | 7/1982 | Busby | 175/374 |
| 4,359,335 | 11/1982 | Garner | 75/208 R |
| 4,386,670 | 6/1983 | Westermark | 299/80 X |
| 4,452,325 | 6/1984 | Radd et al. | 175/410 |
| 4,722,405 | 2/1988 | Langford, Jr. | 175/374 |
| 4,793,427 | 12/1988 | Lambson et al. | 175/373 |

*Primary Examiner*—William P. Neuder

*Attorney, Agent, or Firm*—Graybeal, Jackson, Haley & Jackson

[57] ABSTRACT

A roller cutter assembly comprising a cutter hub adapted for rotation with respect to a rock face and having a peripheral surface with an axially extending width. The first cutter ring is located on the cutter hub. A second cutter ring is also located on the cutter hub. Both the first cutter ring and the second cutter ring are adjustable between at least first locations and second locations along the width of the peripheral surface of the cutter hub such that reorientation of at least one of the first cutter ring and the second cutter ring on the cutter hub alters the axial spacing between the first cutter ring and the second cutter ring, resulting in alteration of the spacing of the cutters located thereon. Reorientation of the first cutter ring and/or the second cutter ring is accomplished by reversing the orientation of the one cutter ring with respect to the other, varying the number of spacers which locate and brace the first cutter ring and second cutter ring on the cutter hub, and/or varying the relative widths of the spacers.

33 Claims, 5 Drawing Sheets

ROLLER CUTTER ASSEMBLY HAVING ADJUSTABLE RING CUTTER SPACING

BACKGROUND OF THE INVENTION

The present invention pertains to a roller cutter assembly for rock boring machines. Rock boring machines have a plurality of these cutter assemblies mounted on a rotatable cutterhead. Conventionally, each cutter assembly includes a shaft which is adapted to be secured to the cutterhead, a hub mounted on bearings for rotation relative to the shaft and the cutterhead, and a cutter ring containing a plurality of cutter elements and being fixedly secured to the hub. The rock breaking elements on the cutter ring can either be a plurality of ring mounted button cutters peripherally mounted on the cutter ring, or the cutter ring itself can be a so-called disc cutter with a peripheral cutting edge. These cutter element arrangements are generically termable cutter ring means.

The hardness of the rock being bored dictates the cutter ring mean spacing, or kerf spacing, required for rock breaking at maximum energy efficiency and cutter survivability. Therefore it is desirable to be able to adjust kerf spacing conveniently. The kerf spacing on a cutterhead is traditionally not constant on the surface thereof.

If the kerf spacing is constant throughout the surface of a cutterhead, the cutters toward the periphery experience higher loads. Hence, the kerf spacing is reduced in positions toward the cutterhead periphery to equalize the cutter loads. When double cutter ring assemblies are substituted for single ring cutter assemblies (to reduce the overall kerf spacing on the cutterhead) the kerf spacing toward the periphery, on the double row cutter ring assemblies must again be decreased to equalize edge loading. Because, until now, the cutter spacing on any given two ring cutter assembly was not adjustable, an assortment of two ring cutter assemblies with progressively decreasing cutter spacing was required to equalize edge loading. There is obviously additional expense associated with maintaining an inventory of a plurality of groups of two ring cutter assemblies each having different cutter key spacing.

A dual ring cutter assembly sold by AB Sandvik Rock Tools of Sweden provides a limited form of variable cutter spacing by allowing the entire cutter assembly to be rotated from a first to a second, reverse, orientation on the cutterhead. However, the two rows of cutter rings on the Sandvik cutter assembly are not adjustable, and thus cutter ring spacing in this type of cutter assembly is not variable based on reorientation of one of the cutter rings with respect to the other. The Sandvik dual ring cutter assembly thus provides a very limited way of adjusting cutter kerf spacing.

Also known in the art is a dual ring disc cutter sold by Wirth of Germany. Neither the cutter assembly itself, nor the two cutter rings thereon are adjustable in any manner.

U.S. Pat. No. 4,793,427 issued to Lambson et al.; U.S. Pat. No. 3,981,370 issued to Bingham et al.; and U.S. Pat. No. 3,766,998 issued to Bower, Jr. all disclose disc cutters with removable cutter rings. U.S. Pat. No. 3,791,465 issued to Metge; U.S. Pat. No. 3,786,879 issued to Murdoc; U.S. Pat. No. 3,596,724 issued to Beechem; and U.S. Pat. No. 2,223,864 issued to Zublin all generally disclose roller cutters known in the art. U.S. Pat. No. 4,722,405 issued to Langford, Jr.; U.S. Pat. No. 4,452,325 issued to Radd et al.; U.S. Pat. No. 4,359,335 issued to Garner; and U.S. Pat. No. 4,339,009 issued to Busby all pertain to button cutter elements for cutter assemblies. However, none of the above patents discloses a cutter assembly having adjustable cutter spacing based on axial alteration of the orientation of the cutters on the cutter assembly.

A need thus exists for a cutter assembly in which cutter spacing is adjustable by axial alteration of the location of the cutter elements on the cutter assembly.

A need also exists for a cutter assembly in which alteration of the location of the cutter elements on the cutter assembly is accomplished by changing the relative direction that one cutter ring is oriented with respect to another cutter ring on the cutter assembly.

A need also exists for a cutter assembly in which the location of the cutter elements on the cutter assembly is altered by varying the number of spacers which brace the cutter rings to the cutter assembly.

A need also exists for a cutter assembly in which the location of the cutter elements on the cutter assembly is altered by changing the relative widths of the spacers employed to brace the cutter rings to the cutter assembly.

SUMMARY OF THE INVENTION

The cutter assembly of the present invention includes a cutter hub adapted for rotation with respect to a rock face. The cutter hub has a peripheral surface with a width. A first cutter ring is secured to the cutter hub and the first cutter ring has cutter elements thereon oriented for rock boring. A second cutter ring is also secured to the cutter hub and has cutter elements thereon for rock boring. Both the first cutter ring and the second cutter ring are circumferentially disposed on the cutter hub, and are both adjustable between at least first and second locations along the width of the peripheral surface of the cutter hub, i.e. axially thereof. Reorientation of at least one of the first cutter ring and the second cutter ring on the cutter hub alters the distance between the first cutter ring and the second cutter ring, thus varying the spacing of the cutter elements thereon.

Preferably, the first cutter ring and the second cutter ring are both asymmetric in cross-section (most preferably substantially L-shaped in cross-section) with an upper cutter element retaining portion, and with a lower leg portion adjacent the peripheral surface of the cutter hub. Thus, cutter element spacing can be adjusted by altering the direction of a lower leg portion of either the first cutter ring or the second cutter ring with respect to the lower portion of the other. However, the first cutter ring and the second cutter ring need not be asymmetric in cross-section and thus can lack the respective lower leg portions.

Preferably, the first cutter ring and second cutter ring are braced on the peripheral surface of the cutter hub by spacer rings which are circumferentially disposed on the cutter hub. These spacer rings can be located on both sides, either side, and/or between the first cutter ring and the second cutter ring. Thus, cutter element spacing can be adjusted by varying both the number of spacer rings, and the relative width of the spacer rings. While these spacer rings are preferably employed, cutter element spacing can be adjusted without the use of spacer rings by employing only the first cutter ring and the second cutter ring having asymmetric (preferably L-shaped) cross-sections; with cutter element spacing being adjusted by altering the direction of the lower leg portion of either the first cutter ring or the second cutter ring with respect to the lower leg portion of the other.

While a first cutter ring and a second cutter ring are preferably employed, more than two cutter rings can also be used. Alternatively, only a single cutter ring can be located on the cutter assembly with adjustment of cutter element spacing then being realized, not by variation of the distance between cutter elements on one cutter assembly, but instead by alteration of cutter spacing between cutter elements on adjacent cutter assemblies.

BRIEF DESCRIPTION OF THE DRAWINGS

These and other features of the present invention will be evident when considered in the light of the following specification and drawings in which.

DETAILED DESCRIPTION OF THE PREFERRED EMBODIMENTS

Figure 1:
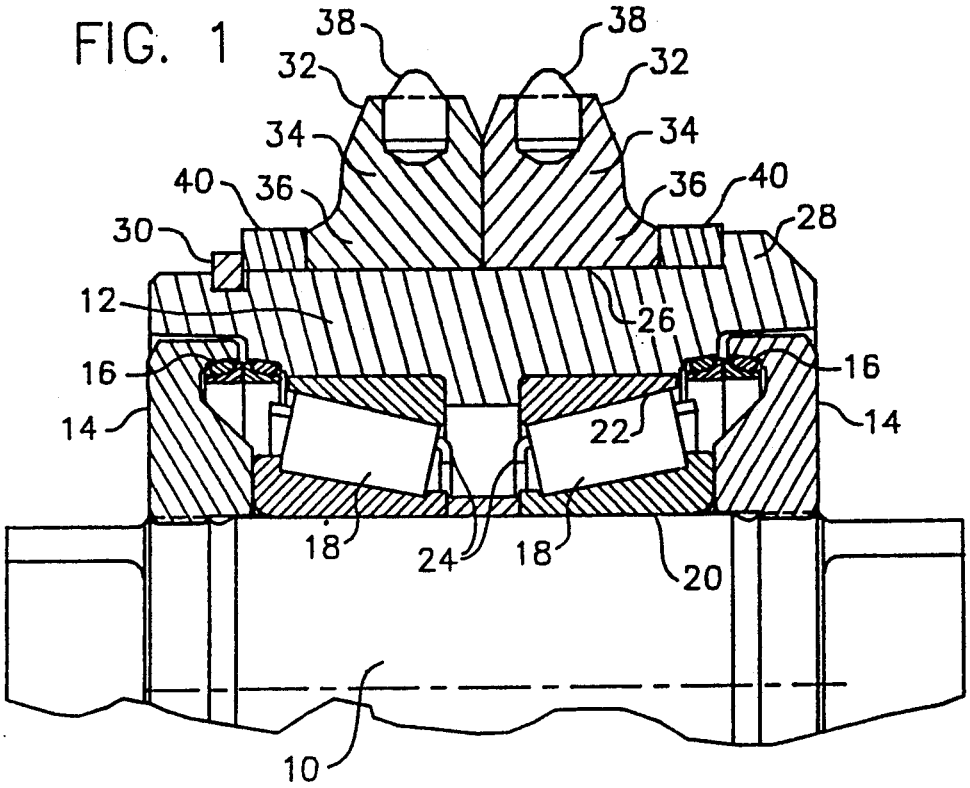
FIG. 1 is a partial cross section of a cutter assembly typifying a first embodiment of the present invention having a first cutter element spacing.

Referring to FIGS. 1 through 9, the illustrated cutter assemblies typical of this invention consist of a shaft 10 on which is mounted a hub 12. Shaft 10 and hub 12 are fixedly secured to the face of a rotatable cutterhead (not shown) of a tunnel boring or raise boring machine in a manner known in the art. Seal carrier 14 is located between shaft 10 and hub 12 and supports bearing seal ring 16. Bearings 18 are typically tapered roller bearings, and the bearing chamber typically is lubricated and sealed by bearing seal rings 16 in a known manner. Inner bearing races 20 support bearings 18 on shaft 10 and outer bearing races 22 support hub 12 on bearings 18 such that outer bearing races 22 and hub 12 roll on bearings 18. Bearing cages 24 retain bearings during relative rotation of hub 12 about axis 25. Hub 12 is circumferentially disposed over shaft 10 such that the rotation of hub 12 on bearings 18 relative to shaft 10 is in a manner conventional per se.

Hub 12, being substantially wheel-shaped, has a peripheral surface 26 of a given width. Shoulder 28 of hub 12 is located on one side, and retaining ring 30 is located on the other side of hub 12. Retaining ring 30 is secureable to hub 12 in a manner known in the art such that attachment of retaining ring 30 to hub 12 braces one or more cutter rings (to be described in further detail below) between retaining ring 30 and shoulder 28 such that these cutter rings are attached to and rotate with hub 12.

Referring now to FIGS. 1 through 4, a first embodiment of the present invention is shown in which a pair of cutter rings 32 are secured to hub 12 between shoulder 28 thereof and retaining ring 30. While two cutter rings 32 are disclosed in the first embodiment of the present invention, it is to be understood that more or less than two cutter rings 32 can be employed in this first embodiment, and all other subsequently disclosed embodiments of the present invention. Each of cutter rings 32 is circumferentially disposed over hub 12 and preferably has a substantially L-shaped cross section dividing each of cutter rings 32 into an upper cutter element retaining portion 34 and a lower leg portion 36. Upper cutter element retaining portion 34 holds cutter elements 38 in an orientation for cutting rock. Cutter elements 38 may be a plurality of tungsten carbide button cutters disposed on each of cutter rings 32. Cutter elements 38 may be either integral with cutter rings 32, or separate members securedly attached thereto in a manner well known in the art. Instead of employing cutter elements 38, cutter ring 32 may instead be a disc cutter with a peripheral cutting portion having a, for example, triangular cross-section which facilitates rock cutting.

Figure 2:
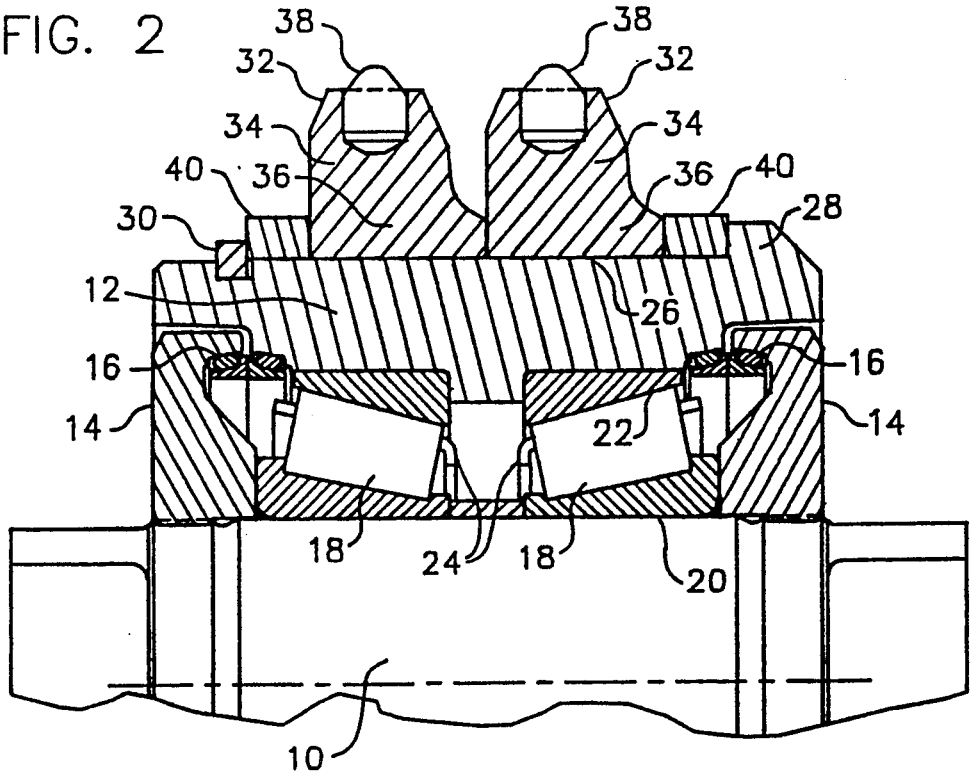
FIG. 2 is a partial cross section of a cutter assembly typifying the first embodiment of the present invention having a second cutter element spacing.
Figure 3:
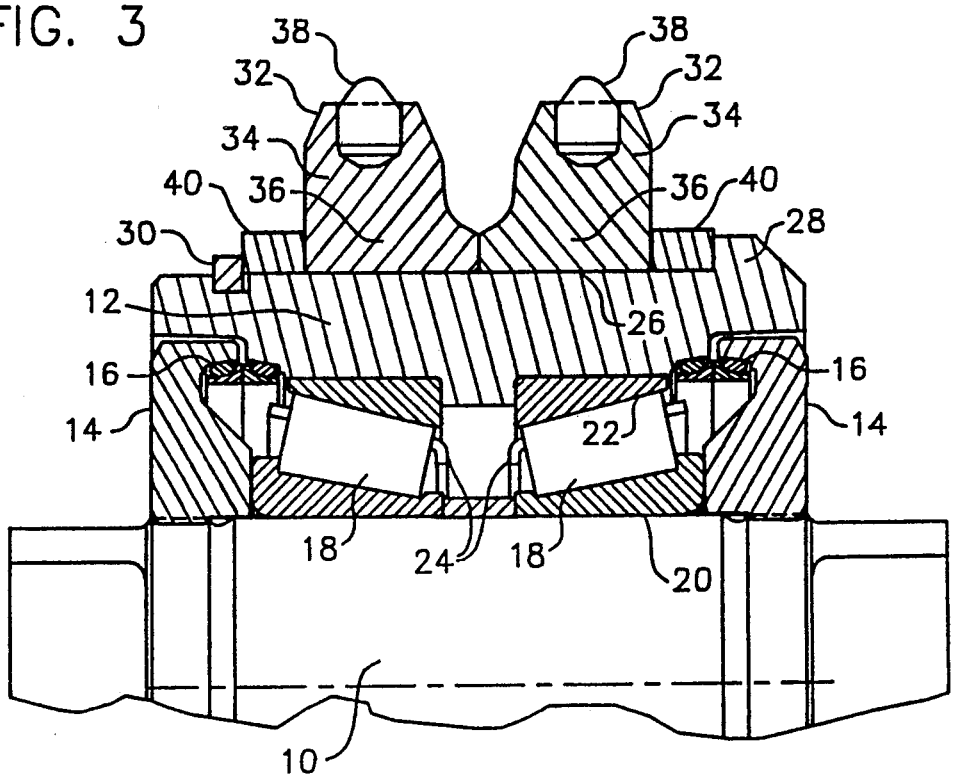
FIG. 3 is a partial cross section of a cutter assembly typifying the first embodiment of the present invention having a third cutter element spacing.

Lower leg portion 36 of each cutter ring 32 provides cutter ring 32 with an asymmetric cross-section that facilitates the adjustable cutter element spacing of the cutter assembly of the present invention. While the asymmetric cross-section of cutter ring 32 is preferably of an L-shape, as described above, other asymmetric cross-sectional configurations which facilitate adjustment of cutter element spacing, can be used. Specifically, as shown in FIG. 1, the lower leg portions 36 of the two cutter rings 32 are oriented away from each other such that the two rows of cutter elements 38 have the shortest cutter spacing distance therebetween. In FIG. 2, the two lower leg portions 36 of cutter rings 32 are oriented in the same direction such that the cutter spacing between cutter elements 38 is wider than that shown in FIG. 1. In FIG. 3, the two lower leg portions of cutter elements 38 are oriented toward each other such that the cutter spacing between cutter elements 38 is greater than that shown in either FIG. 1 or FIG. 2. Thus, alteration of the relative orientation of either one or both of cutter rings 32 along the width of the peripheral surface 26 of cutter hub 12 results in a variation of the cutter spacing between the rows of cutter elements 38.

Figure 4:
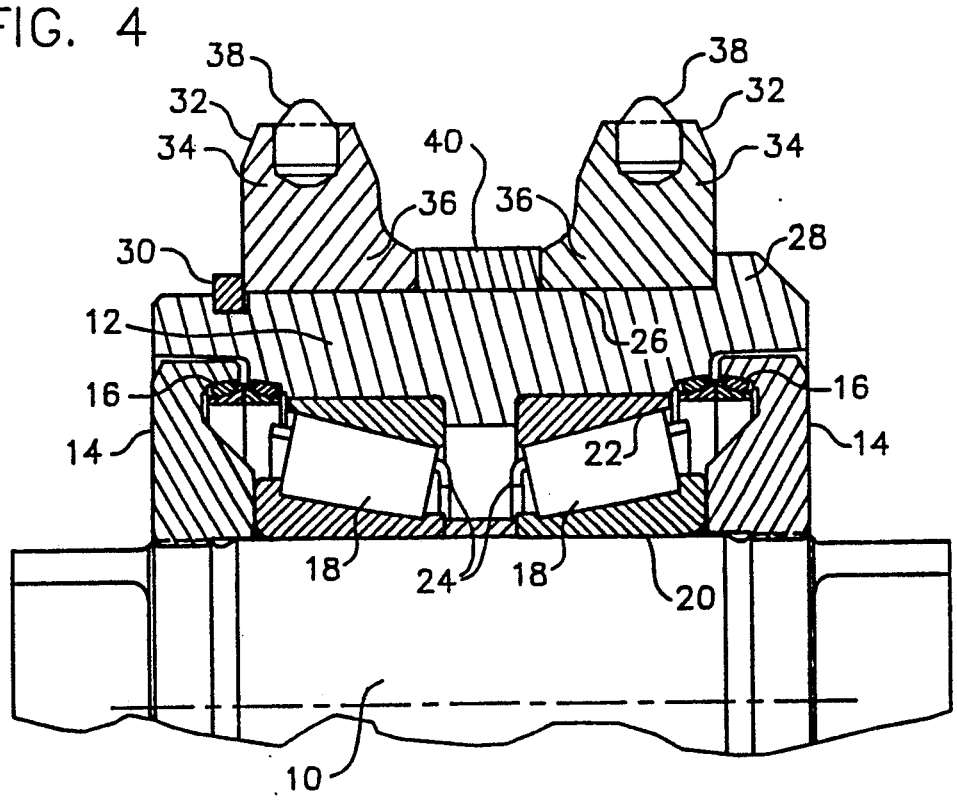
FIG. 4 is a partial cross section of a cutter assembly typifying the first embodiment of the present invention having a fourth cutter element spacing.

FIGS. 1 through 3, described above, disclosed adjustment of the spacing between cutter elements 38 by altering the relative direction of one lower leg portion 36 of a cutter ring 32 with respect to the other lower leg portion 36 of the other cutter ring 32. However, as shown in FIGS. 3 and 4, the spacing between the rows of cutter elements 38 can be adjusted by employing spacer rings 40, with or without alteration of the direction of one lower leg portion 36 of a cutter ring 32 with respect to the other lower leg portion 36 of the other cutter ring 32. Spacer rings 40 are circumferentially disposed over hub 12 and are adapted to be oriented between one of cutter rings 32 and shoulder 28 of hub 12, between the two (or more) cutter rings 32, and/or between retaining ring 30 and one of the cutter rings 32. Thus, when two cutter rings 32 are employed, one, two or three spacer rings 40 can be employed to adjust the cutter spacing between the rows of cutter elements 38. A variable in addition to the number of spacer rings 40 employed is the relative widths of the spacer rings 40. It is thus readily apparent that a practically infinite number of different cutter spacings between cutters 38 can be obtained by employing one, two or three of spacer rings 40 with a variety of spacer rings 40 of different widths. Comparing FIGS. 3 and 4 for example, both of the lower leg portions 36 of cutter rings 32 have the same relative orientation in each of these FIGS. However, the spacing between cutter elements 38 is of a greater distance in FIG. 4 than in FIG. 3 due to the removal of two spacer rings 40 which encircle the two cutter rings 32 in FIG. 3, and the placement of a spacer ring 40 between the two cutter rings 32 in FIG. 4.

It is readily apparent that the addition of a third spacer ring 40 between the two cutter rings 32 in FIG. 3, or the addition of two spacer rings 40 encircling the cutter rings 32 in FIG. 4 could be employed. Additionally, by varying the relative widths of the three spacer rings 40 encircling, and located between, the two cutter rings, a myriad of cutter element spacings can be obtained.

Furthermore, it is readily apparent that the addition of one spacer ring 40 adjacent either shoulder 28 of hub 12 or retaining ring 30 in FIG. 4 would result in yet another cutter spacing as spacer ring 40 located between the two cutter rings 32 is diminished in width by an amount equal to the width of the newly added spacer ring 40. Thus, varying the relative widths of these two spacer rings 40 will also result in a multitude of possible spacings between cutter elements 38.

It is to be understood that while adjustment of cutter spacing employing only a variable number of spacer rings 40 of varying widths has been described, adjustment of cutter element spacing of this type can also be employed in conjunction with adjustment of cutter element spacing by altering the relative direction of one lower leg portion 36 of one cutter ring 32 with respect to the other lower portion 36 of the other cutter ring 32. In sum, any one or more of these three methods (cutter ring assymmetry, spacer ring number and/or spacer ring width) may be employed to vary the location of one or both cutter rings 32 (and their accompanying cutter 38) along the width of peripheral surface 26 of hub 12.

Figure 5:
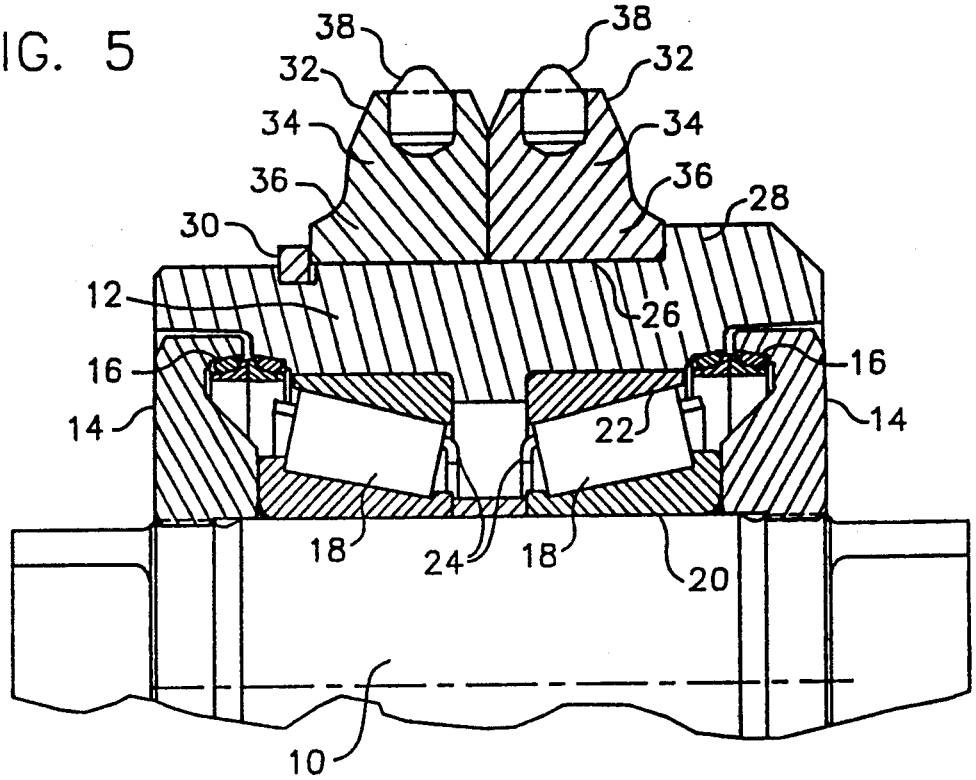
FIG. 5 is a partial cross section of a cutter assembly typifying a second embodiment of the present invention having a first cutter element spacing.
Figure 6:
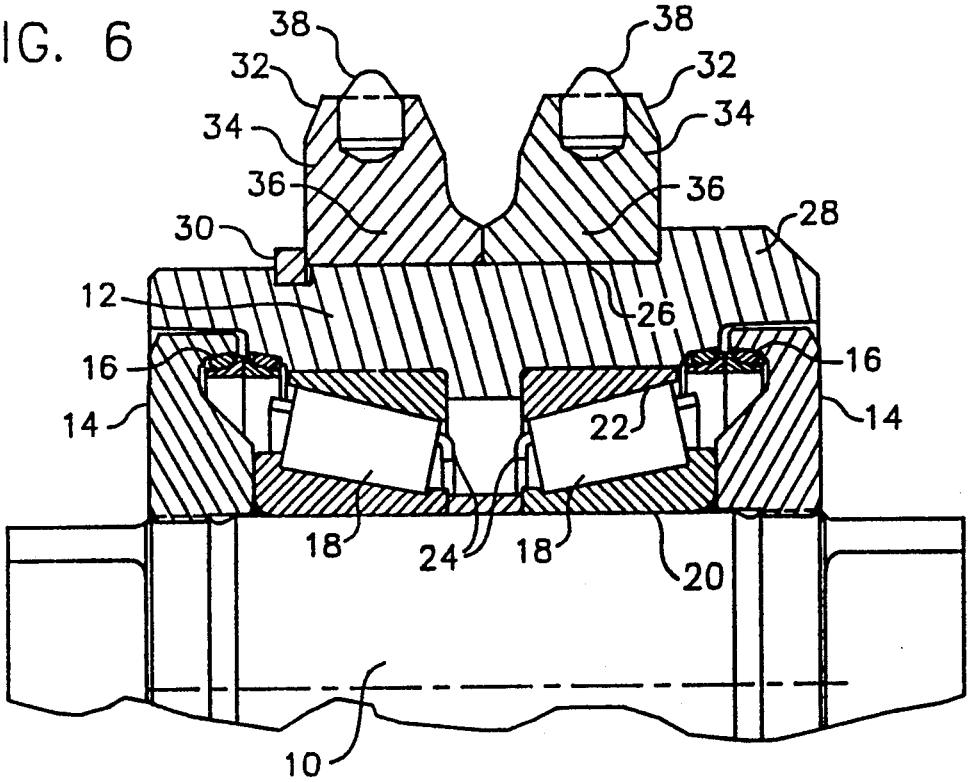
FIG. 6 is a partial cross section of a cutter assembly typifying the second embodiment of the present invention having a second cutter element spacing.

Referring now to FIGS. 5 and 6, a second embodiment of the present invention is shown which is identical in all aspects to the first embodiment of FIGS. 1 through 4 described above except that spacer rings 40 are not present. Adjustment of cutter spacing in this second embodiment is accomplished only by alteration of the direction of one lower leg portion 36 of a cutter ring 32 with respect to the other lower leg portion 36 of the other cutter ring 32. Specifically, FIG. 5 shows the two lower leg portions 36 of the two cutter rings 32 oriented away from each other such that the two rows of cutter elements 38 have the shortest cutter spacing distance therebetween. FIG. 6 shows the two lower leg portions of cutter rings 32 oriented toward each other that the spacing between the rows of cutter elements 38 is greater than that shown in FIG. 5. It should be noted that while FIGS. 5 and 6 show two lower leg portions 36 of equal widths, different cutter rings 32 may be employed having lower leg portions 36 of different relative widths such that the cutter element spacing can be varied not only by alteration of the relative directions of the two lower leg portions 36, but also by variation in the relative widths of the two lower leg portions 36. In other words, varying the relative widths of the two lower leg portions 36 causes these lower leg portions 36 to function in the same manner as the spacer rings 40 of varying widths described in the first embodiment of the invention shown in FIGS. 1 through 4 above. Additionally, instead of having just one lower leg portion 36, each of cutter rings 32 can have two lower leg portions of equal or different widths such that the cross-section of each of cutter rings 32 has the shape of an inverted T.

Figure 7:
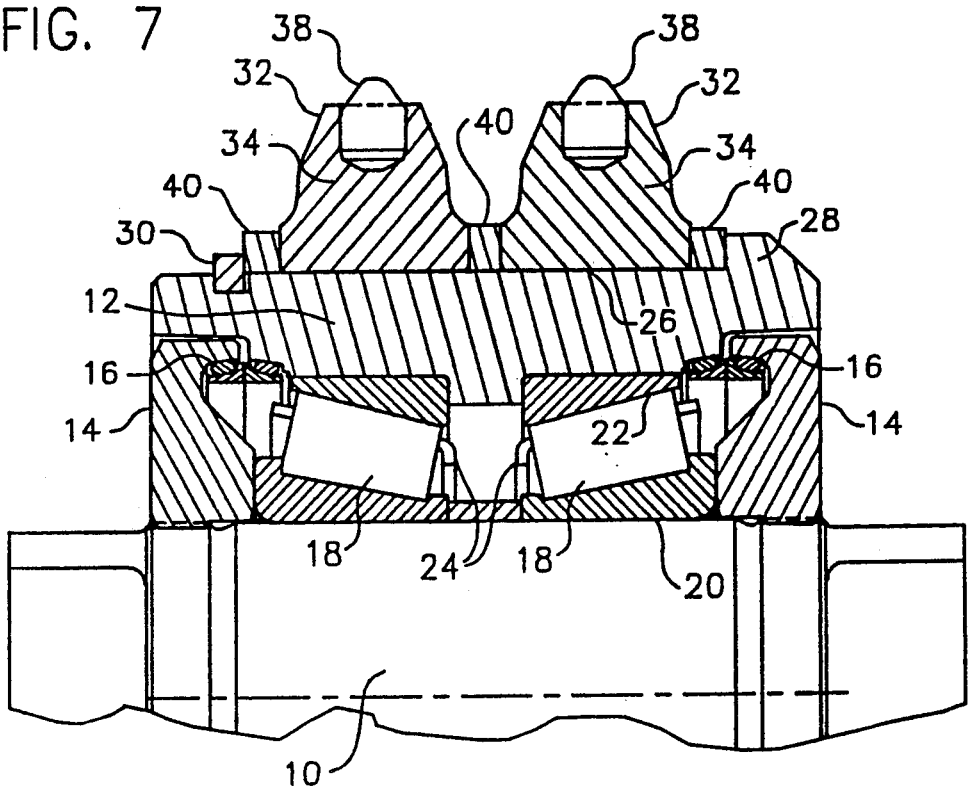
FIG. 7 is a partial cross section of a cutter assembly typifying a third embodiment of the present invention.

Referring next to FIG. 7, a third embodiment of the present invention is shown. This third embodiment is identical in all respects to the first embodiment of the present invention of FIGS. 1 through 4, except that in this third embodiment cutter rings 32 are not substantially L-shaped in cross section and thus lack lower leg portions 36. Thus, adjustment of cutter spacing is only accomplished by varying the number and relative widths of spacer rings 40 in the manner described above in conjunction with the first embodiment of the present invention.

Figure 8:
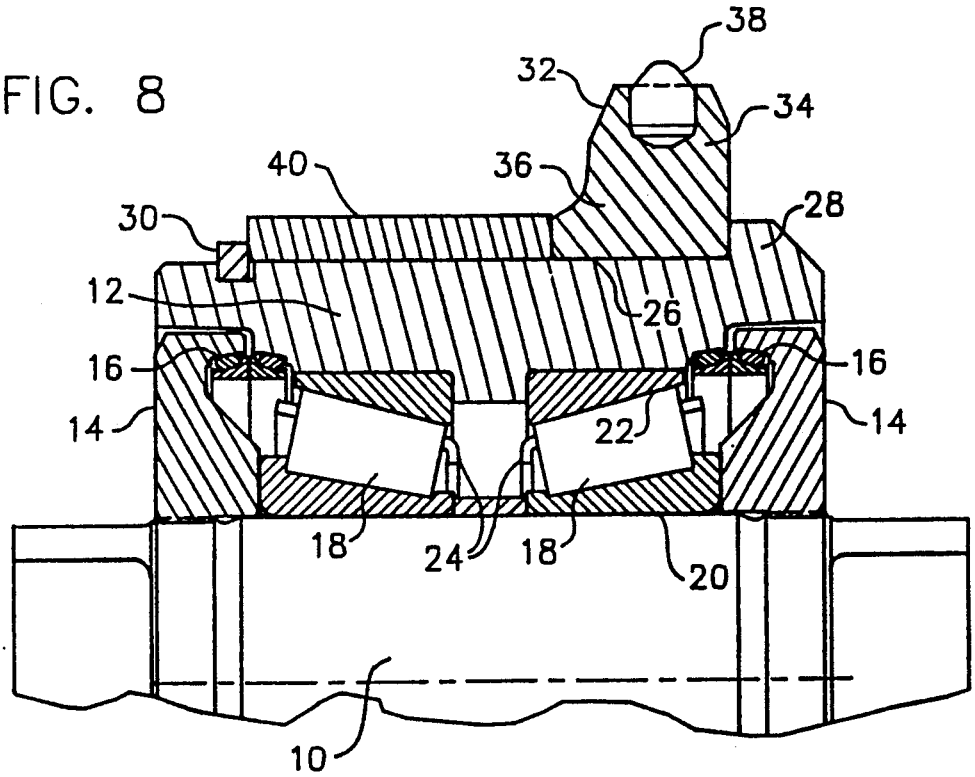
FIG. 8 is a partial cross section of a cutter assembly typifying a fourth embodiment of the present invention having a first cutter element spacing.
Figure 9:
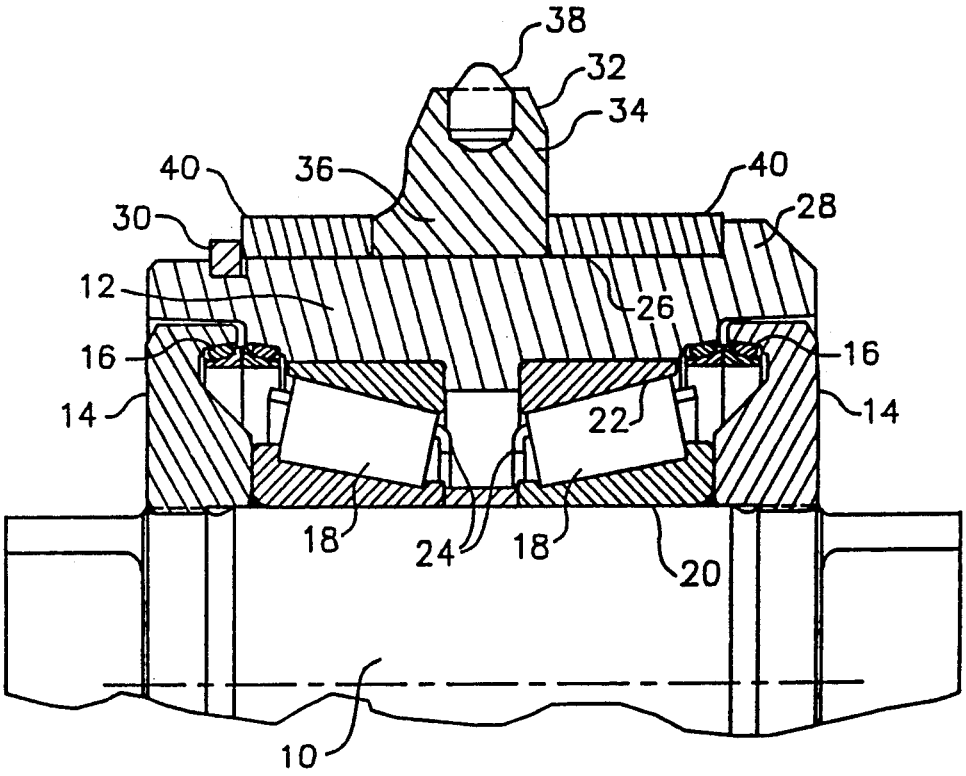
FIG. 9 is a partial cross section of a cutter assembly typifying the fourth embodiment of the present invention having a second cutter element spacing.

Referring to FIGS. 8 and 9, a fourth embodiment of the present invention is shown. This fourth embodiment is identical in all aspects to the first embodiment of the present invention shown in FIGS. 1 through 4 except that a single cutter ring 32 is employed per cutter assembly. Thus, in this fourth embodiment, cutter element spacing is adjustable between two or more cutter assemblies, as opposed to cutter element spacing between two or more cutter bodies on one cutter assembly. Thus, comparing FIGS. 8 and 9, the relative orientation of cutter ring 32 on the cutter assemblies shown has been altered by employing a different number of spacer rings 40 of different widths such that the cutter element spacing between cutter elements 38 on two neighboring cutter assemblies is adjusted. While FIGS. 8 and 9 show adjustment of the cutter element spacing between two cutter assemblies by variation of both the number and relative width of spacer rings 40, it is readily apparent that such cutter element spacing adjustment can occur by any, some, or all of the following methods: varying the number of spacer rings 40, varying the relative widths of the spacer rings 40, and/or varying the relative direction of at least one of lower leg portion 36 (if present) on a cutter ring 32 relative to another lower leg portion 36 on another cutter ring 32 on an adjacent cutter assembly.

The above embodiments are described simply by way of example, and are not to be construed as restrictive. The full scope of the invention is set forth in the following claims, including any and all equivalents thereof.

What is claimed is:

1. A cutter assembly for a rock boring machine comprising:

a single cutter mounting adapted for rotation about an axis of rotation with respect to a rock face, said cutter mounting having a peripheral surface with a width parallel to said axis of rotation;

a first rolling cutter on said cutter mounting, said first rolling cutter oriented for rock cutting, said first rolling cutter being adjustable between at least a first location and a second location along the width of said peripheral surface of said cutter mounting; and means for selectively securing said first rolling cutter on said cutter mounting at said first location and said second location of said single cutter mounting.

2. The cutter assembly of claim 1 further comprising:

a second rolling cutter on said single cutter mounting, said second rolling cutter oriented for rock cutting, said second rolling cutter being adjustable between at least a first location and a second location along the width of said peripheral surface of said cutter mounting; and means for selectively securing said second rolling cutter on said cutter mounting at said first location and said second location of said second rolling cutter such that reorientation of at least one of said first rolling cutter and said second rolling cutter on said cutter mounting alters the distance between said first rolling cutter and said second rolling cutter on said cutter mounting.

3. The cutter assembly of claim 1, wherein said means for selectively securing said first rolling cutter to said cutter mounting comprises:

spacer means on said peripheral surface of said cutter mounting; and retaining means bracing said spacer means against said first rolling cutter.

4. The cutter assembly of claim 1, wherein said first rolling cutter is substantially L-shaped in cross-section with an upper cutter retaining portion, and with a lower leg portion adjacent said peripheral surface of said cutter mounting, said means for selectively securing said first rolling cutter to said cutter mounting comprising:

means for bracing said lower leg portion of said first rolling cutter against said cutter mounting.

5. The cutter assembly of claim 4, wherein said means for bracing said lower leg portion of said first rolling cutter against said cutter mounting comprises:

a spacer ring; and a retaining ring bracing said spacer ring against said lower leg portion of said first rolling cutter.

6. The cutter assembly of claim 1, wherein said first rolling cutter includes tungsten carbide button cutters.

7. The cutter assembly of claim 6, wherein said button cutters are an integral portion of said first rolling cutter.

8. The cutter assembly of claim 6, wherein said button cutters are non-integral members secured to said first rolling cutter.

9. The cutter assembly of claim 1, wherein said first rolling cutter is a disc cutter.

10. A cutter assembly for a rock boring machine comprising:

a cutter hub adapted for rotation about an axis of rotation with respect to a rock face, said cutter hub having a peripheral surface with a width parallel to said axis of rotation;

a first cutter ring on said cutter hub, said first cutter ring oriented for rock cutting, said first cutter ring being substantially L-shaped in cross-section with an upper cutter retaining portion, and with a lower leg portion adjacent said peripheral surface of said cutter hub, said first cutter ring being adjustable between at least a first location and a second location along the width of said peripheral surface of said cutter hub; and means for bracing said lower leg portion of said first cutter ring against said cutter hub at said first location and said second location of said first cutter ring.

11. The cutter assembly of claim 10, wherein said means for bracing said lower leg portion of said first cutter ring against said cutter hub comprises:

a spacer ring; and a retaining ring bracing said spacer ring against said lower leg portion of said first cutter ring.

12. The cutter assembly of claim 10, wherein said cutter ring includes tungsten carbide button cutters.

13. The cutter assembly of claim 12, wherein said button cutters are an integral portion of said first cutter ring.

14. The cutter assembly of claim 12, wherein said button cutters are non-integral members secured to said first cutter ring.

15. The cutter assembly of claim 10, wherein said cutter ring is a disc cutter.

16. The cutter assembly of claim 10, further comprising:

a second cutter ring on said cutter hub, said second cutter ring having a cutter thereon oriented for rock cutting, said second cutter ring being substantially L-shaped in cross-section with an upper cutter retaining portion, and with a lower leg portion adjacent said peripheral surface of said cutter hub, said second cutter ring being adjustable between at least a first location and a second location along the width of said peripheral surface of said cutter hub; and means for bracing said lower leg portion of said second cutter ring against said cutter hub at said first location and said second location of said second cutter ring such that reorientation of at least one of such first cutter ring and said second cutter ring on said cutter hub alters the distance between said first cutter ring and said second cutter ring on said cutter hub.

17. A cutter assembly for a rock boring machine comprising:

a single cutter mounting adapted for rotation about an axis of rotation with respect to a rock face, said cutter mounting having a peripheral surface with a width parallel to said axis of rotation;

a first rolling cutter on said cutter mounting said first rolling cutter oriented for rock cutting, said first rolling cutter being substantially L-shaped in cross-section with an upper cutter retaining portion, and with a lower leg portion adjacent said peripheral surface of said cutter mounting said first rolling cutter being adjustable between at least a first location and a second location along the width of said peripheral surface of said cutter mounting;

a second rolling cutter on said cutter mounting said second rolling cutter oriented for rock cutting, said second rolling cutter being substantially L-shaped in cross-section with an upper cutter retaining position, and with a lower leg portion adjacent said peripheral surface of said cutter mounting, said second rolling cutter being adjustable between at least a first location and a second location along the width of said peripheral surface of said cutter mounting; and means for bracing said lower leg portions of said first rolling cutter and of said second rolling cutter against said cutter mounting at said first location and said second location of said first rolling cutter and said second rolling cutter respectively, such that reorientation of at least one of said first rolling cutter and said second rolling cutter on said cutter mounting alters the distance between said first rolling cutter and said second rolling cutter on said cutter mounting.

18. The cutter assembly of claim 17, wherein ,said means for bracing said lower leg portions of said first rolling cutter and said second rolling cutter against said cutter mounting comprises:

a spacer ring; and a retaining ring bracing said spacer against at least one of said lower leg portion of said first rolling cutter and said second rolling cutter.

19. The cutter assembly of claim 17, wherein said rolling cutters ring include tungsten carbide button cutters.

20. The cutter assembly of claim 19, wherein said button cutters are integral portions of said first rolling cutter and said second rolling cutter.

21. The cutter assembly of claim 19, wherein said button cutters are non-integral members secured to said first rolling cutter and said second rolling cutter.

22. The cutter assembly of claim 17, wherein said rolling cutters are disc cutters.

23. A cutter assembly for a rock boring machine comprising:

a single cutter mounting mounted on a shaft and adapted for rotation about an axis of rotation parallel to a rock face, said mounting having a peripheral surface extending axially of the mounting with a non-variable width;

a rolling cutter positionable at a plurality of selected axial locations on said cutter mounting peripheral surface; and means selectively securing said rolling cutter on said cutter mounting at any of said plurality of selected axial locations.

24. The roller cutter assembly of claim 23, wherein said rolling cutter has an asymmetrical cross-section enabling said rolling cutter to be positionable at a plurality of selected locations on said cutter mounting peripheral surface.

25. The roller cutter assembly of claim 24, wherein said asymmetrical cross-section of said rolling cutter is substantially L-shaped with an upper cutter retaining portion and with a lower leg portion adjacent said cutter mounting peripheral surface.

26. The roller cutter assembly of claim 23, further comprising spacer ring means arrangeable axially with said rolling cutter in various locations on said cutter mounting peripheral surface to change the axial location of said rolling cutter on said cutter mounting peripheral surface.

27. A roller cutter assembly for a rock boring machine comprising:

a single shaft mounted cutter mounting rotatable on said shaft about an axis of rotation and having a cylindrical peripheral surface parallel to and surrounding said axis of rotation; and rolling cutter means orientable and braceable in various locations axially relative to said cutter mounting cylindrical peripheral surface to change the axial location of said rolling cutter means on said cutter mounting or the axial spacing between said rolling cutter means of said roller cutter assembly relative to the rolling cutter means of an adjacent roller cutter assembly.

28. The roller cutter assembly of claim 27, wherein said rolling cutter means has an asymmetrical cross-section enabling said rolling cutter means to be orientable and braceable in various locations axially relative to said cutter mounting cylindrical peripheral surface.

29. The roller cutter assembly of claim 28, wherein said asymmetrical cross-section of said rolling cutter means is substantially L-shaped with an upper cutter retaining portion and with a lower leg portion adjacent said cutter mounting cylindrical peripheral surface.

30. The roller cutter assembly of claim 27, further comprising spacer ring means arrangeable axially with said rolling cutter means in various locations on said cutter mounting cylindrical peripheral surface to change the axial location of said rolling cutter means on said cutter mounting or the axial spacings between said rolling cutter means of said roller cutter assembly relative to the rolling cutter means of an adjacent roller cutter assembly.

31. A roller cutter assembly for a rock boring machine, comprising:

a single shaft mounted cutter mounting rotatable on said shaft about an axis of rotation and having a cylindrical peripheral surface parallel to said axis of rotation, and first and second rolling cutter means orientable and braceable in various locations axially relative to said cylindrical peripheral surface, each of said rolling cutter means having an asymmetrical cross-section enabling the axial spacing between the roller cutter means thereof to be varied by a reversal of the relative positions of one or both of said first and second rolling cutter means on said cutter mounting.

32. A roller cutter assembly of claim 31, further comprising spacer ring means arrangeable axially with said first and second rolling cutter means in various locations on said cylindrical peripheral surface to change the axial spacing between said first and second rolling cutter means.

33. The roller cutter assembly of claim 31, wherein said asymmetrical cross-sections of said first and second rolling cutter means are substantially L-shaped with an upper cutter retaining portion and a lower leg portion adjacent said cylindrical peripheral surface

* * * * *